United States Patent [19]

Robins

[11] 4,178,025

[45] Dec. 11, 1979

[54] NARROW CLEARANCE GATE LATCH

[75] Inventor: Milton Robins, Marina Del Rey, Calif.

[73] Assignee: PTI - Dolco, Los Angeles, Calif.

[21] Appl. No.: 805,464

[22] Filed: Jun. 10, 1977

Related U.S. Application Data

[63] Continuation-in-part of Ser. No. 754,326, Dec. 27, 1976, abandoned.

[51] Int. Cl.[2] ..... E05C 3/04

[52] U.S. Cl. ..... 292/117

[58] Field of Search ..... 292/244, 117, 120, 136, 292/356

[56] References Cited

U.S. PATENT DOCUMENTS

| | | | |
|---|---|---|---|
| 844,907 | 2/1907 | Aikin | 292/136 |
| 1,370,515 | 3/1921 | Brady | 292/136 |
| 1,629,379 | 5/1927 | Dudas | 292/136 X |
| 2,310,348 | 2/1943 | Blears | 292/202 |
| 2,693,381 | 11/1954 | Butler | 292/117 |

*Primary Examiner*—Richard E. Moore
*Attorney, Agent, or Firm*—J. B. McGuire

[57] ABSTRACT

The illustrated gate latches include an anchor plate and a latch plate. The latch plate is pivotally mounted relative to the anchor plate by means of a screw which also serves to hold the anchor plate in place. The anchor plate is shown to include one or more alignment flanges, one or more nailing points, and means to limit pivotal movement of the latch plate such as a pair of pivot stop flanges, all formed integral with the anchor plate. The latch plate includes a cam surface which cooperates with a detent bar to pivot the latch plate until the bar is located within a detent gripping or latching section, allowing the latch plate to pivot in the opposite direction and temporarily fix the bar and the latching plate to one another. The trailing end of the latching plate cooperates with the pivot-stop abutments to limit the pivotal movement of the latching plate in one embodiment. A pin and slot arrangement is employed for the same purpose in a second embodiment.

13 Claims, 9 Drawing Figures

FIG. 4
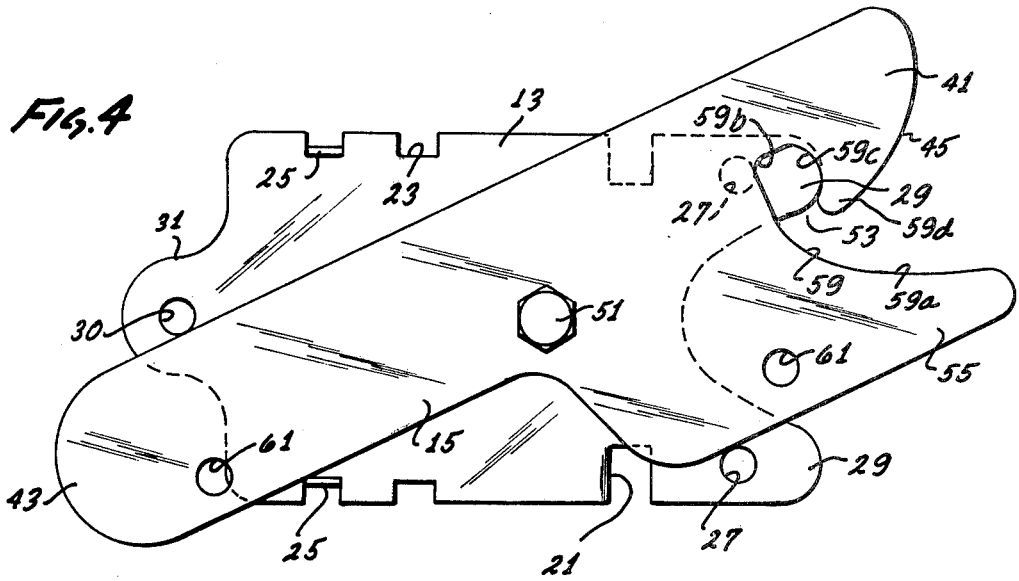
FIG. 6
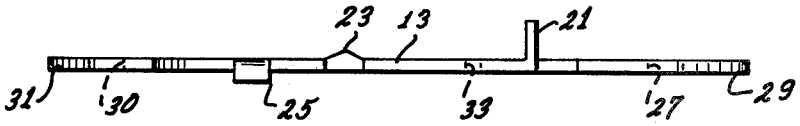
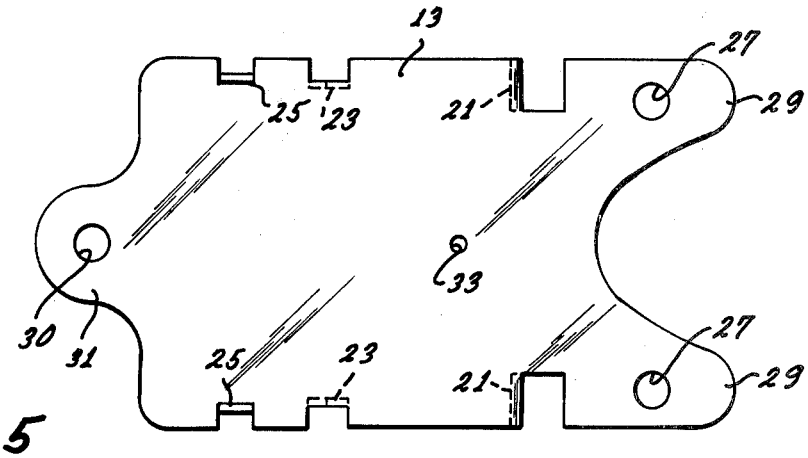
FIG. 5

FIG. 7
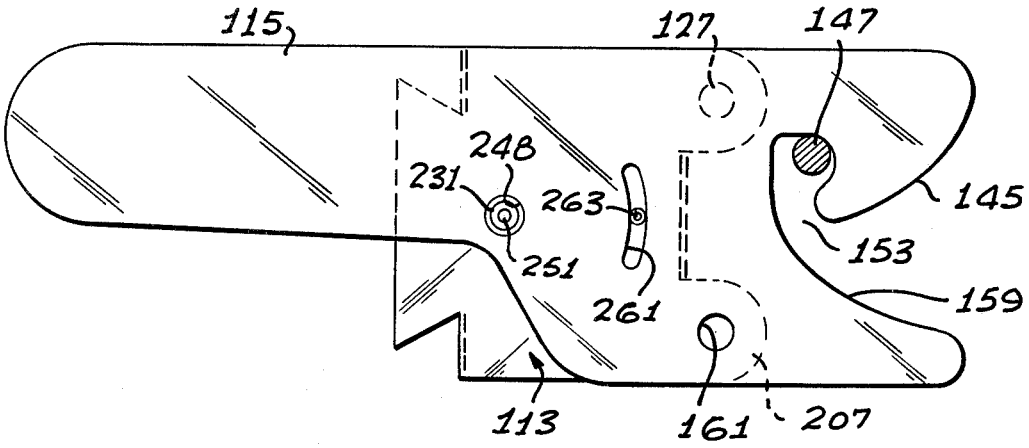
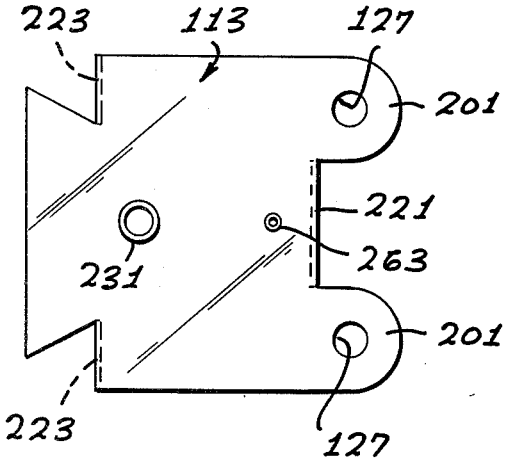
FIG. 8
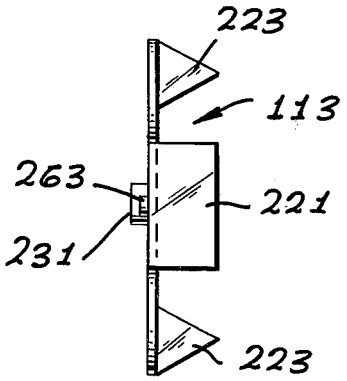
FIG. 9

NARROW CLEARANCE GATE LATCH

This application is a continuation-in-part of U.S. application Ser. No. 754,326, filed Dec. 27, 1976, now abandoned, and assigned to the assignee hereof.

BACKGROUND OF THE INVENTION

When it is desired to latch a gate, i.e., to prevent it from moving relative to a post adjacent to which it may be swung, it has been necessary to provide a two-part mechanism, one of which may be mounted on the gate and the other of which may be mounted on the post. For example, a bar might be mounted on the gate and located with respect to a latching mechanism so that the bar will push the mechanism upward until it reaches a detent portion of the latch, allowing the latter to fall and hold the bar until some manual action is accomplished to raise the latch again. These simple and inexpensive mechanisms are quite satisfactory so long as it is unnecessary to open the gate from the side opposite the latching mechanism. If that function is desired, it then becomes necessary to drill a hole through either the gate or the post, draw a string or wire through the hole, and attach the string to the latch. Then, the latch can be pulled upwardly about its pivot in order to release the bar.

This structure has been found to have several disadvantages. Among them are the tendency of the string or wire to break after a period of time, either due to chafing against the edges of the hole through the post or gate or as a result of bending during repeated pulling in order to open the latch. Also, if the gate or post are of substantial and sturdy material, it is often necessary to drill a hole having an axial length of 4 inches or more. In this instance it is often very difficult for the average homeowner to drill such a hole without purchasing a relatively expensive drill bit for which he may have no other use.

Accordingly, it has become known to provide a gate latch which can be installed in the space between the gate and the post. One such latch comprises a plate which may be mounted on the gate or post by means of a pair of lag screws, etc. To that plate, an elongated latch lever may be pivotally attached. The lever may extend far enough toward one side of the gate to cooperate with a detent bar and far enough on the opposite side of the gate to be pushed by someone who desires to open the gate, causing the latch to move away from the bar temporarily. In this prior art device, a second plate must be provided and fixedly mounted to the plate which is attached to the post or gate. In this structure, the latch lever is captured between the two parallel plates and is pivotally mounted therebetween by a small bolt or screw.

Unfortunately, this prior art device has proven to be unsatisfactory. The device is so thick that either the gate and its adjacent post must be approximately ¾ of an inch or more apart, or else the gate and/or post must be routed out to allow the relatively thick mechanism to be placed between them.

Accordingly, it has become desirable to provide a latching mechanism which will fit between a gate and its adjacent post without requiring unusual clearances between the gate and the post and/or requiring the removal of material from either the gate or the post in order to mount the mechanism and allow it to be used. Further it is also desirable to provide such a latching mechanism which may be quickly and simply mounted using a minimum of skill and only those tools commonly found in the tool kit of even the least mechanically inclined or skilled homeowner. Additionally, it is preferred that such a mechanism be so designed that professional gate installers need only a minimum parts inventory to latch all gates they install, whether wood, steel, or right or left handed swinging.

SUMMARY OF THE INVENTION

The present invention relates to a novel gate latch which can be installed in a very narrow opening between a gate and the post against which it can be swung. The latch may be produced through a simple stamping operation and may be installed very quickly and easily using, for example, only a hammer.

In accordance with a preferred embodiment of the present invention, the latch may be very thin, essentially comprising two flat plates. One plate may be fixed in place on either the gate or the post and the other plate may be pivotally mounted on the fixed or anchored plate. Also, if desired, the fixed plate may be formed in a substantially symmetrical manner so that it can be reversed, i.e., used with either a right or left hand swinging gate. In other words, the anchor plate may be anchored in any desired position and the pivoting or latching plate may be mounted on the anchor plate by means of a single screw which may also serve as a mounting screw to hold the anchor plate in place.

In one presently preferred embodiment, the anchor plate may be formed with one or more locating flanges which, for example, may be positioned so as to cooperate with the corner of a post or a gate in order to locate and properly align the plate. Similarly, the plate may be provided with one or more integral nailing points which may be driven into the wood of the gate or post to aid in the anchoring of the fixed plate. Of course, these points may be flattened out or filed off, if necessary, if the mechanism is to be mounted on a metal gate or post such as by welding. The fixed plate may also be provided with a pair of pivot stop means such as flanges which define the limits of movement of the pivot or latch plate when the latter is mounted on the anchor plate.

Alternatively, the anchor plate may be provided with a pin extending from the face thereof in such a manner as to cooperate with a slot in the latch plate. Contact between the pin and the ends of the slot will limit the pivotal movement of the latch plate. The pin may be extruded from the anchor plate or it may comprise a tapered press or roll pin driven into a bore formed in the plate. If desired, of course, the pin could be extruded from or otherwise mounted in the latch plate to similarly cooperate with a slot in the anchor plate.

The latch plate may include, on its leading edge, a first cam surface which will cooperate with a locking or detent bar to pivot the plate upwardly until the bar is aligned with a detent section of the plate. The detent section may also be formed with second and third cam surfaces so that the plate will be forced to pivot downwardly, even if the gate "bounces" or rebounds when it is slammed shut, and the detent portion will be forced to grip the bar to prevent movement of the gate. Preferably, the leading end of the plate may also be provided with a biasing portion having weight sufficient to always present the first cam edge of the latch plate to the locking bar. Movement of the bar against the second cam surface will generate a torque about the pivot screw to cause the latch plate to pivot into a position such that the detent section will be forced onto the bar to grip it. Also, if the latching plate happens to be in the raised position when the bar strikes the cam surface on the detent portion of the latch plate, the torque generated will force the latch plate to grip the bar.

The opposite or trailing end of the latch plate may extend a distance beyond the opposite edge of the gate and post sufficient for a person on the opposite side of the gate from the locking bar to press down on the trailing end. This action will lift the detent portion of the latch plate away from the bar so that the gate can be pushed open. If desired, the second cam surface on the detent portion of the latch plate will, when the detent portion of the plate is pivoted upwardly, push on the bar and initiate relative movement between the gate and the post.

Also, if desired, a plurality of alignable bores may be formed in the two plates so that a padlock shackle can be passed therethrough to lock the gate from either, or at least one, side thereof.

Preferably, both of the plates, and expecially the latch plate, are of relatively thin, but strong, material. Coaxially alignable bores of different diameters may be formed in the plates and a bearing larger in diameter than the smaller bore may extend into the larger bore, thereby supporting the latch plate for pivotal movement. A headed fastener, such as a bolt, may be passed through the aligned bores. If the head has a nominal diameter greater than the diameter of the bore in the latch plate, the fastener will hold the plates together and to the gate/post structure.

Upon reading the following Detailed Description, taken together with the accompanying drawings, those skilled in the art will realize that the present invention may be embodied in a very simple, inexpensive, and easily installed structure which provides the above and many other advantages over the prior art devices. They will also realize, however, that the present invention may, if desired, be embodied in additional structures which might not even resemble that depicted within the drawings, but which, nevertheless, will employ the teaching and spirit of the present invention. Similarly, they will realize that, although the terms "gate" and "post" are used extensively throughout this specification and the claims, such terms are for convenience only and shall be construed to encompass any such relatively movable structures, whether they swing, slide, or whatever.

BRIEF DESCRIPTION OF THE DRAWINGS

FIG. 4 comprises a view, similar to FIG. 1, illustrating the relative position of the mechanism parts in a maximum pivotal relationship thereof;

FIG. 5 comprises an elevation view of an anchor plate which may be employed with the present invention;

FIG. 6 comprises a plan view of the anchor plate seen in FIG. 5;

FIG. 7 comprises an elevation view of an alternate embodiment of a latching mechanism which may be formed in accordance with the present invention, illustrating the relative positions of the plates when the gate and post are latched;

FIG. 8 comprises an elevation view of an anchor plate which may be employed with the present invention and, particularly, with the latch plate of FIG. 7; and FIG. 9 comprises an end view of the anchor plate of FIG. 8.

DETAILED DESCRIPTION

Figure 1:
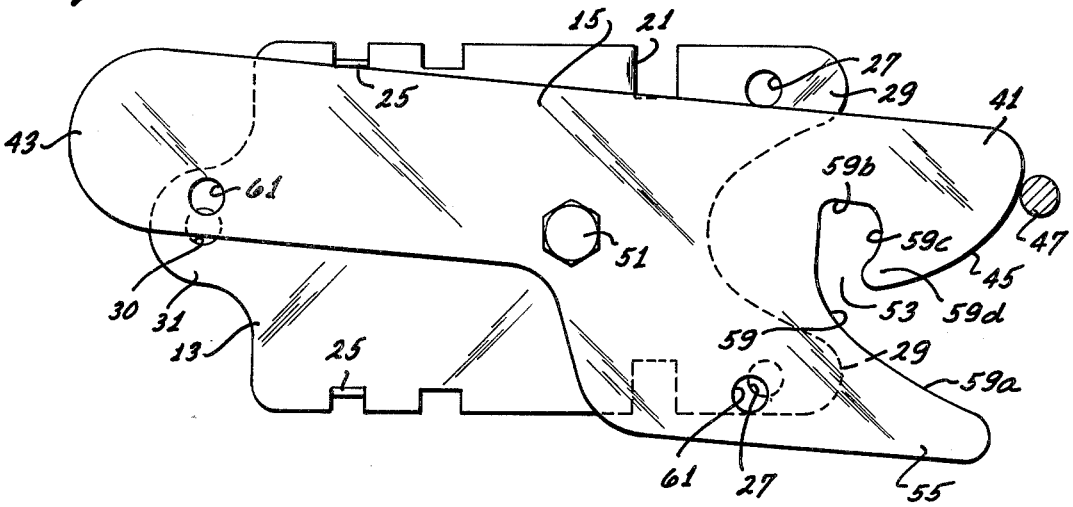
FIG. 1 comprises an elevation view of a latching mechanism which may be formed in accordance with the present invention, showing the relative positions of the mechanism parts when the gate and post, to which the device may be attached, are not latched together.

As shown in FIG. 1, a mechanism which may be formed in accordance with a preferred embodiment of the present invention may comprise a fixed or anchor plate 13 and a pivot or latching plate 15, both of which may be elongated but relatively thin. The anchor plate 13, shown most clearly in FIGS. 5 and 6, may be provided with one or more flanges 21, oriented so as to be substantially perpendicular to the plane of the plate. These flanges 21 may be used to abut against an edge of a gate or post in order to mount the plate at a corner of such a structure. Thus, the flanges aid in locating and aligning the plate. As can be seen from the figures, the flanges may be formed, if desired, merely by partially severing and bending a portion of the plate into the configuration illustrated. Similarly, one or more nailing points 23 may be formed integral with the plate in substantially the same manner. These nailing points may, if desired, be driven into the wood of the gate or post to which the anchor plate 13 is to be attached, thereby aiding in mounting the plate to that structure. If the plate is to be attached to a metal gate or post, however, the points 23 may, if necessary, be filed off or flattened out.

One or more stop flanges 25 may also be formed integral with the plate, as illustrated, to be used in a manner to be described presently. Further, during or after the construction of the plate, one or more bores 27, large enough to allow for the passage of a padlock shackle therethrough, may be formed within front extensions 29 of the plate and a similar bore 30 may be formed within a rear extension 31 of the plate. Also, a relatively central bore 33 may be formed in the plate for a purpose to described presently.

As can be seen from a brief study of the plate shown in FIG. 5, the plate may thus be produced in a substantially symmetrical configuration, if desired, thereby allowing it to be used either in the position shown in FIG. 5 or reversed 180° so that the extensions 29 are to the reader's left and the extension 31 to the reader's right. This allows the entire mechanism to be used on either right or left hand swinging gates and to be mounted on either the gate or the post. Consequently, it will be realized that only a minimum inventory is required to allow this mechanism to be installed and used by either a homeowner or professional installer.

Referring again to FIG. 1, the latching or locking plate 15 may, for the sake of convenience, be described as having a leading end 41 and a trailing end 43. The leading end or edge may comprise a first cam surface 45 which is formed so as to cooperate with a detent bar 47. The detent bar may be formed in any desired configuration, including many which are well known. In any event, if the anchor plate 13 is mounted on the post, the bar 47 would be mounted on the gate, and vice versa.

Near the central position of the latch plate 15, a bore 48 (FIG. 2) may be made large enough to receive a washerlike bearing 49. A relatively thin headed drive screw 51 may be driven through the bearing 49 and the coaxially aligned anchor plate bore 33. It is presently preferred that the axial dimension of bearing 49 be slightly greater than the thickness of plate 15 and the nominal or effective outer diameter of the head of screw 51 be larger than the diameter of bore 48. In other words, if plate 15 is manufactured from 12-gauge metal and bearing 49 may have an axial dimension equal to 11-gauge, the drive screw 51 may be hammered home as far as possible without interfering with the ability of plate 15 to pivot about the edge of bearing 49. At the same time, the head of screw 51 will extend beyond the periphery of bore 48 to prevent movement of plate 15 away from plate 13.

Figure 2:
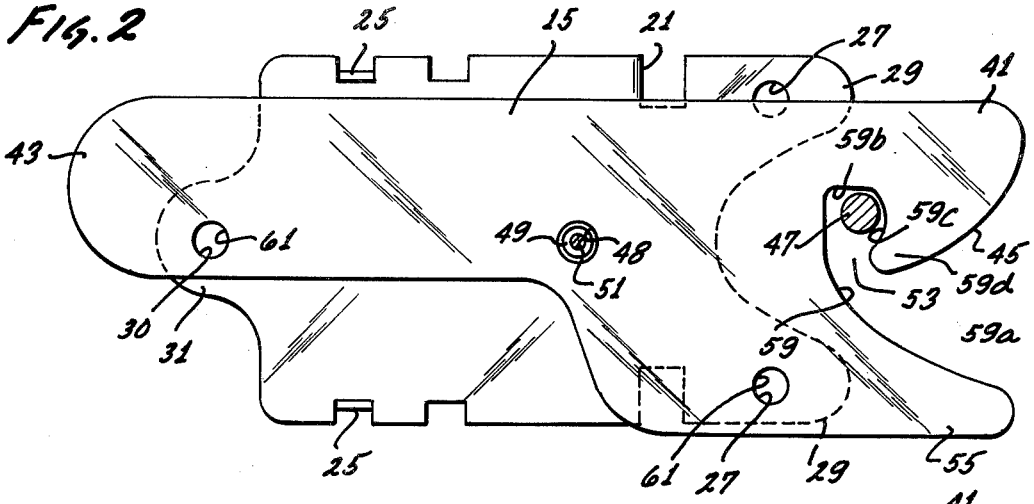
FIG. 2 comprises a view similar to FIG. 1, illustrating the relative positions of the elements when the gate and post are latched.
Figure 3:
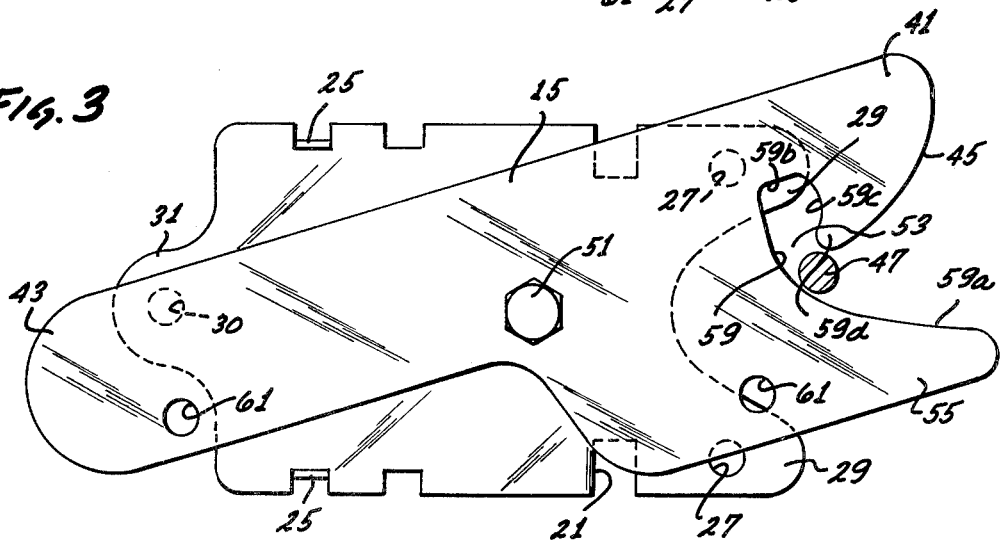
FIG. 3 comprises a view similar to FIG. 1, illustrating the relative position of the parts of the mechanism just as the gate is about to unlatch or latch.

As the gate moves toward the closed position, the bar 47 will come into contact with the first cam surface 45, causing the latching plate 15 to move from the position shown in FIG. 1 to the position shown in FIG. 3. As the bar travels past the end of the latch end cam surface 45, it will become aligned with a detent gripping or receiving notch or opening 53. If desired, the latching plate 15 may be designed so that the bottom section 55 of the leading end 41 is sufficiently heavy to generate a small torque about the pivot 51. Thus, when the bar 47 becomes aligned with the detent opening 53, the plate 15 will be biased so as to pivot from the position shown in FIG. 3 to that shown in FIG. 2, causing the bar 47 to be locked within the notch 53.

Normally, when a gate is closed, it is swung shut with some force. To prevent the gate from bouncing open upon impact, a second cam surface 59 may be formed on the latching plate 15 which will cause the plate 15 to be forced downwardly when bar 47 hits the cam surface 59. This causes a positive gripping of the latching bar within the detent, preventing the gate from bouncing open if the gate is swung shut with some force. It will be seen that the greater the closing force, the more positive is the grip of the latching member 15 on the locking bar 47.

Cam surface 59 may be considered to extend from a location at approximately 59*a*, through sections 59*b* and 59*c*, to detent section nose 59*d*. Alternatively, sections 59*a* and 59*c* (at least) may be considered to be different cam surfaces, with the surface of nose 59*d* within the notch 53 forming a portion of cam surface 59*c*. As bar 47 moves along the surface from 59*a* to 59*b* (FIG. 3), it causes the nose 59*d* to be positively pushed downwardly below the axis or effective leading edge of the bar. If the gate then bounces or rebounds in the opposite direction, the bar 47 will move against nose 59*d* and cam surface section 59*c*, thus continuing to force the latch plate downwardly so as to positively grip the bar within the detent 53. In other words, this mechanism relies upon a positive mechanical force to lock the gate, and this force is generated by the relative movement between the gate and the post. Stated in still another way, this novel compound-cam arrangement (59*a* and 59*c*) makes constructive use of the reaction forces generated by slamming the gate.

As can be seen from FIG. 1, in order to prevent the torque generated by the weight of section 55 from pivoting the latch plate 15 to a position in which the cam surface 45 cannot cooperate with the bar 47 as just described, the trailing end 43 of the latch plate may cooperate with the pivot stop abutment 25 at the upper edge of the plate 13 as illustrated. Thus, the upper abutment flange or pivot stop 25 defines one limit of pivoting of the plate 15.

When someone desires to open the gate, if he is on the side of the gate upon which the leading end 41 of the latch plate is located, he only needs to lift the latch by putting his finger beneath the section 55 and pushing upwardly. On the other hand, if he is on the opposite side of the gate, he need only push down on the trailing end 43 to the position shown in FIG. 3. If desired, the second cam surface 59 may be so configured that, when the person opening the gate moves the pivot plate 15 to the position shown in FIG. 3, the cam surface 59 will "kick" the bar 47 away from the gripping or detent opening 53. This action will initiate opening the gate which can then be completed by pulling on the bar 47, a handle, or some other means. As soon as the latch is released, it will return to the position shown in FIG. 1 so that the latch plate and bar will again cooperate in the manner described previously when the gate is swung shut.

If desired, the plate 15 may be provided with a plurality of apertures 61 which will be aligned with the apertures 27 and 30 when the gate is latched as shown in FIG. 2, thus allowing a padlock to be installed on either side of the gate if it is desired to lock the gate against unauthorized opening.

Since the plate 15 may be produced so as to be substantially flat, the installation of the device is greatly facilitated. It is believed that the installation of the device is already clear with respect to the illustrations of FIGS. 1–4 and the above description. If, on the other hand, it is desired to put the leading end 41 of the latch plate 15 on the other side of the gate, or to the left as seen in the figures, it is only necessary to reverse the anchor plate as described previously and then to mount the pivot plate 15 in the opposite direction, i.e., so that the side of the pivot plate closest to the viewer in FIGS. 1–4 is positioned against the anchor plate. Since the anchor plate is, preferably, produced so as to be substantially symmetrical, the device will work in exactly the manner described previously.

As an additional advantage of producing the anchor plate in the manner described, it will be seen from FIG. 4 that the lower abutment or pivot stop flange 25 will cooperate with the under or lower edge of the trailing end 43 of the latch plate. This cooperation will prevent the plate from being pivoted so far about the pivot 51 that the leading end 41 stops against the upper pivot stop 25, thus removing the detent latching notch 53 from a position in which it can cooperate with the bar 47 to lock the gate. Thus, even if the plate 15 should be pivoted to the position shown in FIG. 4 and held there by someone, the bar 47 will then cooperate with the cam surface 59 to pull the latch plate in a clockwise direction, as seen in FIG. 4, and force the bar to enter into cooperation with the notch 53.

Referring now to FIGS. 7–9, a presently preferred alternate embodiment of the previously described structure has been illustrated, including an anchor plate 113 and a latching plate 115. This alternative latching plate may cooperate with a locking bar 147 by means of a detent notch or opening 153. Similarly, the latching plate 115 may be provided with cam surfaces 145 and 159 which are substantially identical to those of the previously described embodiment. The latching plate 115 may also be provided with a padlock shackle-receiving bore 161 for cooperation with one of the coaxially alignable bores 127 in the anchor plate 113. Since these structures and their desired functions are essentially identical to the previously described preferred embodiment, no further description thereof is deemed necessary here.

Referring to FIGS. 8 and 9, it can be seen that the plate 115 may be provided with extensions 201. A portion of the plate between those extensions may be severed from the extensions and bent to a position substantially perpendicular to the plane of the plate to form one or more abutment flanges 221. Such a flange may be used to abut against an edge of a gate or post to mount the plate at a corner or edge thereof. Similarly, at the opposite end of the plate, a pair of nailing points 223 may be partially severed from and bent perpendicular to the plane of the plate 115, so as to extend substantially perpendicularly therefrom in the same direction as the abutment flange 221. Thus, and similarly to the previous embodiment, the installer need only place the flange 221 against the corner of a gate or post and then force the nailing points 223 into the wood with a hammer, thus locating the anchor plate 115 in the position which he desires.

In this particular preferred embodiment of the present invention, the anchor plate 115 may be provided with an extrusion 231 forming a substantially circular flange bearing. The flange 231 may fit into an aperture 248 in the latch plate 115 with sufficient clearance to allow the latch plate to freely pivot about the outer periphery of the flange. Thus, as the anchor plate 113 is produced, the flange 231 may be formed by any suitable process, such as extrusion, with suitable dimensions for fitting within the aperture 248.

When the device is to be installed, the anchor plate 113 may be mounted on a gate or post in the manner previously described and the latch plate 115 positioned so that the aperture 248 is telescopically received over the flange 231. Preferably, flange 231 may be slightly larger, in its axial dimension, than the thickness of the plate 115. As a result, when a drive screw or suitable bolt 251 is passed through the center of the flange and driven into the wood, its head will cause the plate 115 to be fixed in position on the flange so that it is parallel to the plane or plate 113 and held in that position. However, the slightly greater flange dimension will prevent the head of bolt 251 from interfering with the pivotal movement of the latch plate.

In order to determine the upper and lower limits of pivotal motion of the latch plate 115, if desired, a curved slot 261 may be formed in the latch plate which may cooperate with a pin 263 formed in the anchor plate. Thus, as the latch plate 115 pivots about the periphery of the flange 231, its pivotal motion will be limited due to contact between the pin 253 and the extremities of the slot 261. Slot 261 may be formed with a constant radius centered on the axis of aperture 248.

Pin 263 may be formed in any desired manner. For example, it may also be extruded from plate 115. Alternatively, an aperture may be formed in the anchor plate and a tapered drive pin or roll pin may be driven into that aperture. Of course, the length of the pin 263 need only be such as to extend into the curved slot 261. In other words, it need only extend from the face of plate 115 a distance equal to the height of the extruded flange 231, or perhaps slightly less as illustrated in FIG. 9. Of course, the pin and slot arrangement could be reversed, i.e., the pin located in the latch plate and the slot in the anchor plate, if desired.

As will be realized by those skilled in the art, the device illustrated in FIGS. 7–9 may also be mounted so as to accommodate gate closure in the opposite direction, merely by rotating the anchor plate 180° about an axis extending from the plane of the drawing and turning the latching plate 115 so that the viewer is seeing the opposite surface of the plate with notch 153 to the left.

Having now read the above description, those skilled in the art will realize that various embodiments of the present invention may be exceptionally simple and inexpensive to produce and install. Of course, additional embodiments of the invention will become apparent to those skilled in the art. For example, the anchor points and stop flanges might be replaced by additional fastening screws or nails which pass through the anchor plate. In such a case the heads of the screws would serve as stops or abutments for the pivoting of plate 15. Similarly, the features which are unique to the above-described embodiments may be combined with one another in various combinations and forms. Nonetheless, such additional embodiments shall not avoid the fair and proper scope of the invention as defined in the following claims.

I claim:

1. A latching mechanism for selectively preventing relative movement between two otherwise relatively movable structures comprising bar means suitable for fixed mounting on a first movable structure;

a plate means suitable for pivotal mounting on a second relatively movable structure and having a first cam surface on a leading edge thereof, a nose section adjacent one end of said first cam surface, a bar-receiving notch opening adjacent said nose section and having a second cam surface on a portion of the periphery of said notch relatively distal from said nose section, a third cam surface on a portion of the periphery of said notch adjacent said nose section, a bar holding surface on the periphery of said notch intermediate said second and third cam surfaces;

means for pivotally mounting said plate means to a relatively movable structure including anchor plate means including means for fixedly locating and mounting said anchor plate means on such a relatively movable structure and means for attaching said plate means to said anchor plate means for relative pivotal movement therebetween, for retaining said plate means and said anchor plate means in a parallel relationship, and for holding said plate means and said anchor plate means in place relative to a relatively movable structure comprising an aperture of predetermined first diameter in said anchor plate means, an aperture of predetermined second diameter in said plate means, said first and second diameters being unequal, bearing means having an outer diameter which is larger than the diameter of one of said apertures and smaller than the diameter of the other of said apertures and a greater axial length than the thickness of the one of said plate means and said anchor plate means having the larger of said apertures, said bearing means being seatable within the larger of said apertures, and fastening means extending through said bearing means and the smaller one of said apertures and including means thereon, having a nominal diameter greater than that of the larger of said apertures, for preventing relative movement between the plates in a direction parallel to the axis of said fastening means.

2. The mechanism of claim 1 wherein said bearing means comprises a flange means integral with said anchor plate means extending about said aperture of first diameter therein, the peripheral diameter of said flange being less than said second diameter of said plate means aperture.

3. The mechanism of claim 1 including means for limiting the relative pivotal movement of said plate means and said anchor plate means comprising slot means of predetermined length in one of said plate and anchor plate means and means in the other of said plate and anchor plate means extendible into and cooperable with the ends of said slot means.

4. The mechanism of claim 1 wherein said first cam surface is so located on said leading edge of said plate as to ensure cooperation with said bar means to affect pivotal movement of said plate means in a first direction, said second cam surface is so located on said portion of the periphery of said notch relatively distal from said nose section as to ensure cooperation with said bar means to affect pivotal movement of said plate means in a second direction, and said third cam surface is so located on said portion of the periphery of said notch opening adjacent said nose section and on the opposite side of said nose section from said first cam section as to ensure cooperation with said bar means to affect pivotal movement of said plate means in said second direction.

5. The mechanism of claim 1 wherein said fastening means has a drivable head thereon of a nominal diameter greater than the diameters of said apertures whereby said fastening means may be driven through said aperture and said bearing means, when they are coaxially aligned, to hold said plate means on said anchor plate means without inhibiting the pivotal movement thereof.

6. A mechanism for latching a gate to a post comprising a detent bar mountable upon a gate or post;

a latch plate mountable upon a gate or post so as to be movable relative to said detent bar for latching cooperation therewith and pivotally movable relative to the structure upon which it is mounted, and including a detent bar receiving notch including a first cam surface for cooperation with said detent bar when the latter and said anchor plate are moved relative to one another in a first direction a second cam surface for cooperation with said detent bar when the latter and said anchor plate are moved relative to one another in a second direction, and a detent bar holding means intermediate said first and second cam surfaces, each of the latter being so configured as to cause said detent bar to move relatively toward said holding means when said bar is in contact with either of said first and second cam surfaces;

a pivot aperture in said latch plate; and anchor means mountable upon the other of a gate or post from that upon which said bar is mountable and including means for pivotally supporting said latch plate comprising an aperture in said anchor means coaxially alignable with said pivot aperture bearing means having an internal diameter substantially equal to the diameter of said aperture, an external diameter substantially equal to the diameter of said pivot aperture in said latch plate, and an axial length greater than the thickness of said latch plate in the vicinity about said pivot aperture in said latch plate, and fastening means extendible through and substantially coaxially alignable with said anchor means aperture, said bearing means, and said pivot aperture and having a headed end thereon of a dimension, measured substantially perpendicular to the axis thereof, greater than the diameter of said pivot aperture.

7. The mechanism of claim 6 including means, fixedly mountable upon the structure to which said latch plate may be mounted, for limiting the pivotal movement of said latch plate and wherein said latch plate further includes slot means therein of predetermined length and operatively relatable to said limiting means so that the latter abuts the ends of said slot means at each of the predetermined limits of pivotal movement thereof.

8. The mechanism of claim 6 wherein said latch plate further includes a pivot aperture therein; and said mechanism also includes bearing means locatable within said aperture, and fastening means for fixedly locating said bearing means and having means thereon for contacting said bearing means and having a nominal diameter greater than that of said aperture.

9. The mechanism of claim 6 wherein said anchor means also includes abutment means for limiting pivotal movement of said latch plate about said bearing means.

10. The mechanism of claim 6 wherein said mechanism further includes slot means in one of said latch plate and said anchor means having a pair of opposed slot ends and pin means in the other of said latch plate and said anchor means and extending into said slot means for cooperation with said pair of opposed slot ends to limit pivotal movement of said latch plate.

11. The mechanism of claim 10 wherein said pin means comprises an integral extrusion in said other of said latch plate and said anchor means.

12. The mechanism of claim 11 wherein said bearing means comprises an integral extrusion in said anchor means forming an axial flange about said anchor means aperture.

13. The mechanism of claim 6 wherein said anchor plate means further includes means for locating and fixing said anchor plate means to a gate or post upon which it may be mounted.

* * * * *